United States Patent [19]

Im et al.

[11] Patent Number: 4,896,983

[45] Date of Patent: Jan. 30, 1990

[54] PROTECTING SLEEVE WITH COVER AND CLIP

[76] Inventors: Byung-Do Im, 17214 Horst Ave., Cerritos, Calif. 90701; George Spector, 233 Broadway Rm. 3815, New York, N.Y. 10007

[21] Appl. No.: 100,301

[22] Filed: Sep. 23, 1987

[51] Int. Cl.[4] ..... B43K 9/00

[52] U.S. Cl. ..... 401/107; 401/91; 401/108; 401/117

[58] Field of Search ..... 401/91, 108, 117, 104, 401/105, 107, 59

[56] References Cited

U.S. PATENT DOCUMENTS

| | | | |
|---|---|---|---|
| 1,717,731 | 6/1929 | Nikonow | 401/108 X |
| 1,919,133 | 7/1933 | Rolot | 401/59 |
| 2,092,459 | 9/1937 | Kutter | 401/117 |
| 2,405,958 | 8/1946 | Kelley | 401/107 X |
| 2,413,234 | 12/1946 | Johnson | 401/117 X |
| 2,416,112 | 2/1947 | Moore | 401/107 |
| 3,741,665 | 6/1973 | Smagala-Romanoff | 401/117 |
| 3,810,700 | 5/1974 | Bryan | 401/59 |

FOREIGN PATENT DOCUMENTS

| | | | |
|---|---|---|---|
| 308606 | 9/1917 | Fed. Rep. of Germany | 401/107 |
| 1051676 | 1/1954 | France | 401/59 |
| 1491052 | 6/1967 | France | 401/59 |
| 2563163 | 10/1985 | France | 401/104 |
| 192516 | 2/1923 | United Kingdom | 401/108 |

*Primary Examiner*—Steven A. Bratlie

[57] ABSTRACT

A writing instrument with a slide cap is provided in which the slide cap with a moveable cover is slideable along casing of the instrument from a position wherein it protects the writing tip of the instrument, to a position wherein the writing tip is exposed.

3 Claims, 2 Drawing Sheets

PROTECTING SLEEVE WITH COVER AND CLIP

BACKGROUND OF THE INVENTION

The instant invention relates generally to ball point pens and more specificaly it relates to a writing instrument with a slide cap.

Numerous ball point pens have been provided in prior art that are adapted to include telescopic caps which retract from and extend over the writing tip ends of the pens. For example, U.S. Pat. Nos. 3,740,159; 4,459,059 and 4,580,919 all are illustrative of such prior art. While these units may be suitable for the particular purpose to which they address, they would not be as suitable for the purposes of the present invention as heretofore described.

SUMMARY OF THE INVENTION

A primary object of the present invention is to provide a writing instrument with a slide cap that will overcome the shortcomings of the prior art devices.

Another object is to provide a writing instrument with a slide cap in which the slide cap with a movable cover is slideable along the instrument from a position wherein it protects the writing tip, to a position wherein the writing tip is exposed.

An additional object is to provide a writing instrument with a slide cap that will prevent insertion of a clip on the slide cap onto a web of material when the slide cap is in a retracted position exposing the writing tip.

A further object is to provide a writing instrument with a slide cap that is simple and easy to use.

A still further object is to provide a writing instrument with a slide cap that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
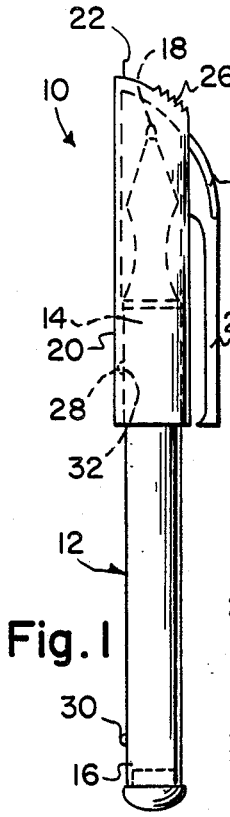
FIG. 1 is a side view of a first embodiment of the invention with the slide cap in an up position.
Figure 2:
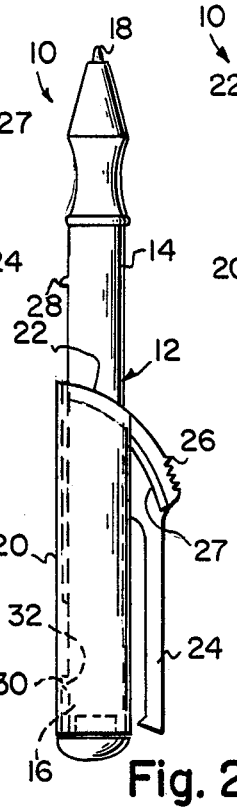
FIG. 2 is a side view thereof with the slide cap in a down position.

Turning now descriptively to the drawings, in which similar reference characters denote similar elements throughout the several views, FIGS. 1 through 19 illustrate a writing instrument 10, such as a ball point pen or the like, that consists of an elongated casing 12 with a first portion 14 and an oppositely disposed second portion 16. A writing tip 18 is at remote end of the first portion 14 of the casing 12. A slide cap 20 that has an opening 22 at distal end thereof is telescopically received over the first portion 14 of the casing 12 and moveable along the casing between (1) a retracted position in which the slide cap 20 overlies the second portion 16, thus leaving the writing tip 18 exposed and (2) an extended position in which the slide cap 20 covers the writing tip 18, thus protecting the writing tip. The slide cap 20 is releasably retained in each of the retracted and extended positions. A clip 24 is affixed to the slide cap 20 for insertion onto a web of material (not shown) such as a pocket or the like. A cover 26 is moveably received at 27 over the opening 22 at the distal end of the slide cap 20 between (1) an open position in which the cover 26 exposes the opening 22 thus allowing the slide cap to go into the retracted position and (2) a closed position in which the cover 26 conceals the opening 22 after the slide cap 20 goes into the extended position.

The slide cap 20 is releasably retained by two spaced apart external protrusions 28 and 30. One of the protrusions 28 is on the first portion 14 and the other protrusion 30 is on the second portion 16 of the casing 12. The slide cap 20 has an internal indentation 32 receivable on the respective protrusions 28 and 30.

Figure 3:
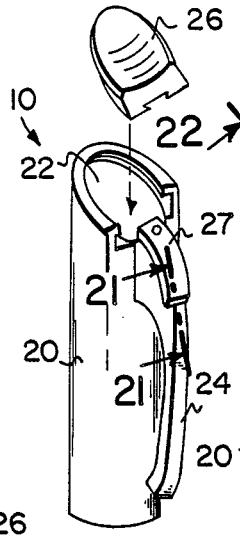
FIG. 3 is a perspective view of the slide cap with the top removed.
Figure 4:
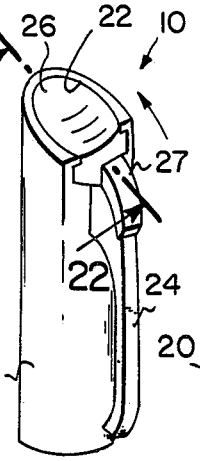
FIG. 4 is a perspective view of the slide cap with the top in a closed position.
Figure 5:
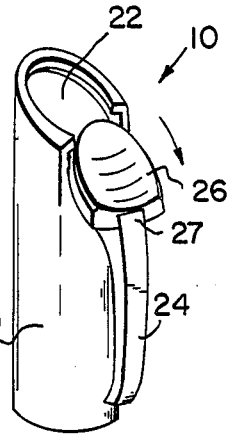
FIG. 5 is a perspective view of the slide cap with the top in an open position.
Figure 6:
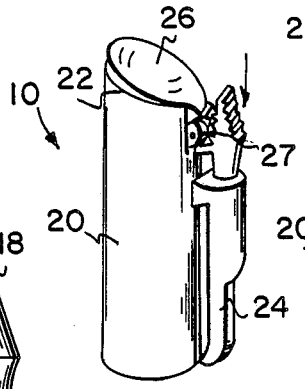
FIG. 6 is a perspective view of a second embodiment of the slide cap with the top closed.
Figure 7:
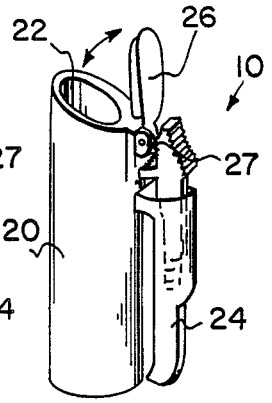
FIG. 7 is a perspective view thereof with the top opened.
Figure 8:
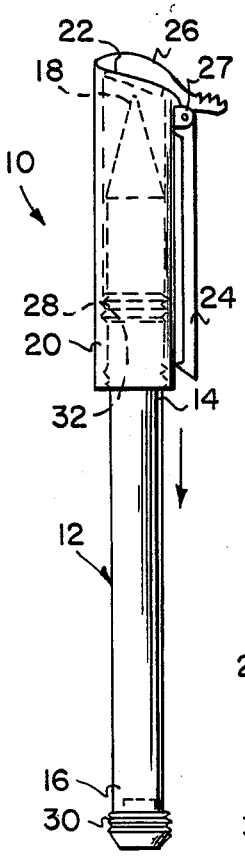
FIG. 8 is a side view of a third embodiment with the slide cap in an up position.
Figure 9:
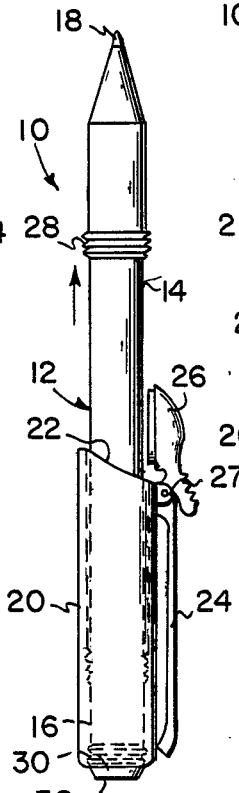
FIG. 9 is a side view thereof with the slide cap in a down position.

The cover 26 (FIGS. 1 and 5) is slideable on cap 20 in grooves at the cap top as seen more clearly in FIGS. 3, 4 and 5. The cap 26 is slidably mounted on the upper end of clip 24 which fits into a coacting groove in cap 26 as best shown in FIG. 5.

Figure 20:
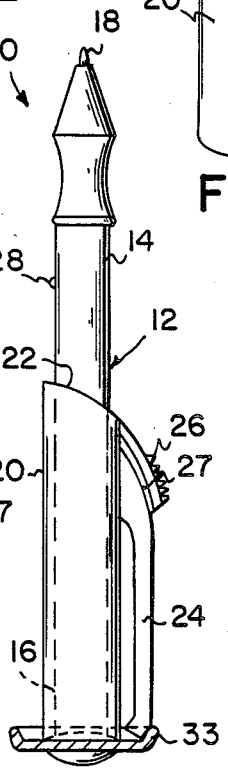
FIG. 20 is a side view of a seventh embodiment with parts broken away with the slide cap in a down position and a flange ring secured to the casing to prevent insertion of the clip onto a web of material.

FIG. 20 shows a flange ring 33 secured to remote end of the second portion 16 of the casing 12 to prevent insertion of the clip 24 onto the web of material when the slide cap 20 is in the retracted position.

Figure 21:
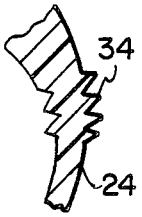
FIG. 21 is a cross sectional view as taken along line 21—21 in FIG. 3 showing an accordian stop which allows bending of the clip.

FIG. 21 shows the clip 24 further including an accordian segment 34 formed therein which allows bending of the clip when the clip 24 is inserted onto the web of material.

Figure 22:
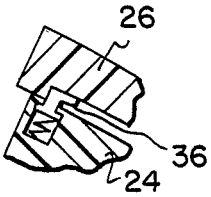
FIG. 22 is a cross sectional view as taken along line 22—22 in FIG. 4 showing a modified pressure stopper on top of the clip.

FIG. 22 shows a spring biased pressure stopper 36 on top of the clip 24 so as to engage with the cover 26 when the cover is in the open position.

The cover 26 is slid downwardly on clip 24 until stopper 36 engages the inner end of cover 26 thus clearing opening 22 for movement of the cap to the retracted position.

FIGS. 6, 7, 8 and 9 show embodiments where the cover 6 is pivotally mounted at the top of cap near opening 22 and moveable to an open position for retraction, by manually pressing the outer end of cover 26 (FIGS. 8 and 9) or by a sliding member at the top of clip 24 which coacts with complimentary ratchet means on cover 26 (FIGS. 6 and 7) whereby up and down motion of the sliding member causes opening and closing pivotal movement of the cover 26.

Figures 10, 11, 12, 13, 14, 15, 16, 17, 18, 19:
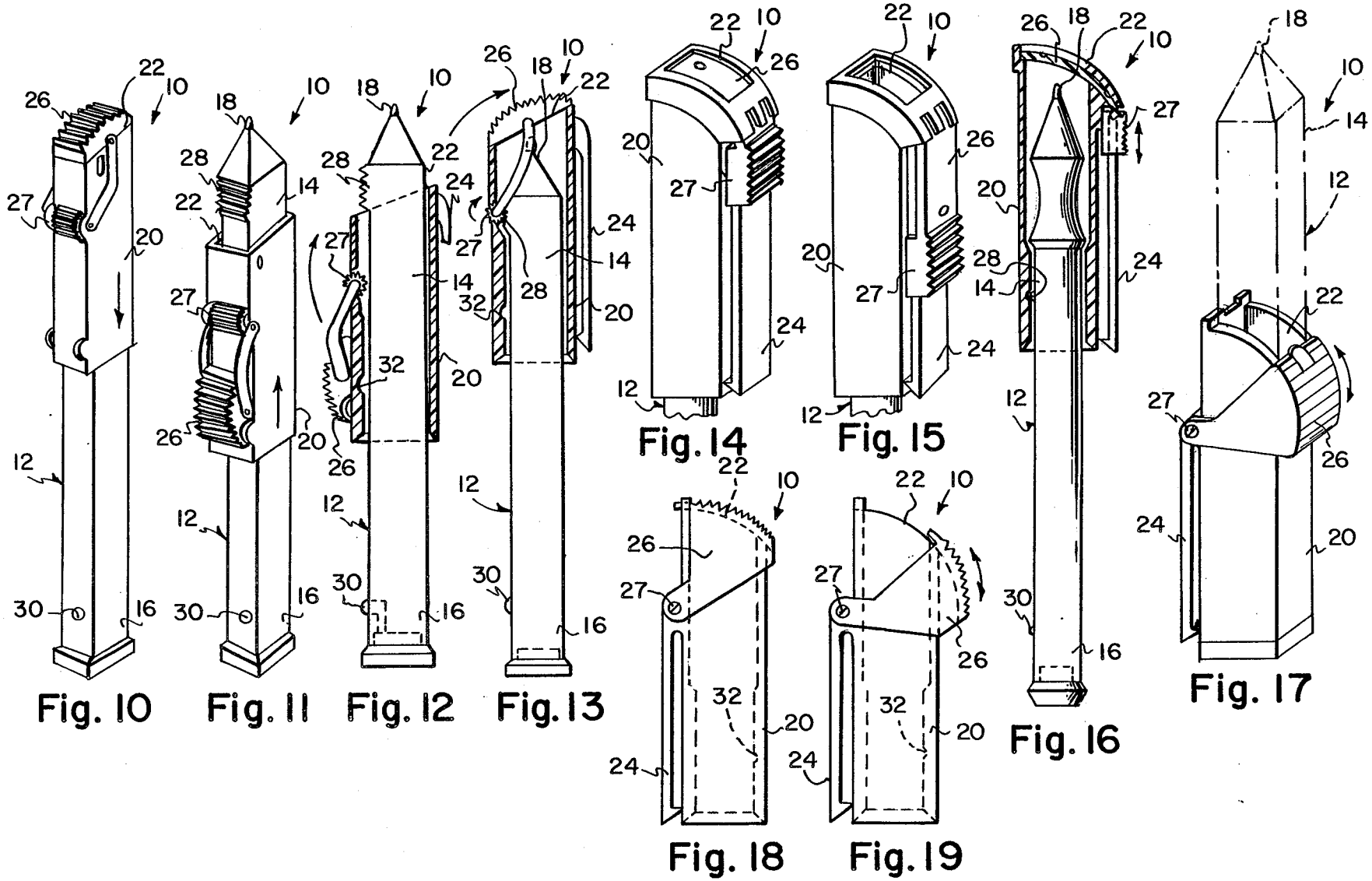
FIG. 10 is a perspective view of a forth embodiment with slide cap in an up position.
FIG. 11 is a perspective view thereof with the slide cap in a down position.
FIG. 12 is a side view similar to FIG. 11 with the slide cap in section.
FIG. 13 is a side view similar to FIG. 10 with the slide cap in section.
FIG. 14 is a perspective view of a fifth embodiment with parts broken away with the slide cap in an up position and cover closed.
FIG. 15 is a perspective view thereof with parts broken away with the slide cap in an up position and the cover open.
FIG. 16 is a side view thereof similar to FIG. 14 with slide cap and cover partly in section.
FIG. 17 is a perspective view of a sixth embodiment with the casing in phantom, the slide cap in a down position and the cover open.
FIG. 18 is a side view thereof of the slide cap and the cover closed.
FIG. 19 is a side view thereof of the slide cap and the cover open.

In FIGS. 10, 11, 12 and 13 the cover 26 is pivotally mounted on a rectangular clip lock 24 by means of parallel arms which position the cover 26 over the opening or along a side in an open position of FIG. 11.

In FIGS. 14 and 15 the cover 26 slides on clip 24 and has an upper flexible portion which is guided by the upper portion of cap 20 to a closed position (FIG. 14) and can be retracted to an open position downward on Clip 24 (FIG. 15).

In FIGS. 17–19, the cover 26 pivots on Clip 24 at pivot point 27 from a position closing opening 22 (FIG. 18) to a position clearing opening 22 (FIGS. 17 and 19).

Stopper 36 (FIG. 22) prevents cover 26 from detaching from clip 24.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A writing instrument which comprises:

(a) an elongated casing with a first portion and an oppositely disposed second portion;

(b) a writing tip at remote end of the first portion of said casing;

(c) a slide cap having an opening at a distal end thereof being telescopically received over the first portion of the casing and moveable along said casing between (1) a retracted position in which said slide cap overlies the second portion, thus leaving said writing tip exposed and (2) an extended position in which said slide cap covers said writing tip, thus protecting said writing tip;

(d) means for releasably retaining said slide cap in each of the retracted and extended positions;

(e) a clip affixed to said slide cap for mounting onto a web of cloth material of the user;

(f) a cover movably mounted on said cap adjacent said opening when said cap is moved to said retracted position and (2) a closed position in which said cover conceals said opening when said slide cap is in said extended position; and (g) means external of the cap on the clip for manually moving said cover to the open and closed position, wherein the cover is pivotally mounted on the clip and includes pivotal arms for movement from an open position spaced externally from said distal end to a closed position.

2. A writing instrument which comprises an elongated casing with a first portion and an oppositely disposed second portion;

(b) a writing tip at a remote end of the first portion of said casing;

(c) a slide cap having an opening at a distal end thereof being telescopically received over the first portion of the casing and moveable along said casing between (1) a retracted position in which said slide cap overlies the second portion thus leaving said writing tip exposed and (2) an extended position in which said slide cap covers said writing tip, thus protecting said writing tip;

(d) means for releaseably retaining said slide cap in each of the retracted and extended positions;

(e) a clip affixed to said slide cap for mounting onto a web of cloth material of the user;

(f) a cover movably mounted on said cap adjacent said opening when said cap is moved to said retracted position and a closed position in which said cover conceals said opening when said slide cap is in said extended position; and (g) means external of the cap on the clip for manually moving said cover to the open and closed positions, wherein said retaining means includes:

(h) two spaced apart external protrusions, one of said protrusions on the first portion and other of said protrusions on the second portion of said casing;

(i) said slide cap having an internal indentation receivable on said respective protrusions and wherein;

(j) said cover is slideably mounted on said clip and slides into a groove at said distal end of said clip, further comprising a flange ring secured to remote end of the second portion of said casing to prevent insertion of said clip onto said web of cloth material when said slide cap is in the retracted position.

3. A writing instrument as recited in claim 2, further comprising a spring biased pressure stopper on top of said clip so as to engage with said cover when said cover is in the open position.

* * * * *